United States Patent [19]

Moeny et al.

[11] Patent Number: 4,741,405

[45] Date of Patent: May 3, 1988

[54] FOCUSED SHOCK SPARK DISCHARGE DRILL USING MULTIPLE ELECTRODES

[75] Inventors: William M. Moeny; James G. Small, both of Albuquerque, N. Mex.

[73] Assignee: Tetra Corporation, Albuquerque, N. Mex.

[21] Appl. No.: 768

[22] Filed: Jan. 6, 1987

[51] Int. Cl.[4] ..... E21B 7/15

[52] U.S. Cl. ..... 175/16; 175/17

[58] Field of Search ..... 175/2, 15–17

[56] References Cited

U.S. PATENT DOCUMENTS

| | | | |
|---|---|---|---|
| 2,953,353 | 9/1960 | Allen . | |
| 3,158,207 | 11/1964 | Rowley | 175/16 |
| 3,500,942 | 3/1970 | Smith, Jr. | 175/16 |
| 3,506,076 | 4/1970 | Angona | 175/57 |
| 3,679,007 | 7/1972 | O'Hare | 175/16 |
| 3,708,022 | 1/1973 | Woodruff | 175/2 |
| 3,840,078 | 10/1974 | Allgood et al. | 175/15 |
| 4,412,967 | 11/1983 | Winterberg | 175/16 |

FOREIGN PATENT DOCUMENTS

| | | |
|---|---|---|
| 435356 | 11/1974 | U.S.S.R. . |
| 647450 | 2/1979 | U.S.S.R. . |

OTHER PUBLICATIONS

Steiger, "Russian Elect. Arc Drill Nears Oil Field Test Stage", Drilling, 1958, Mar.

Maurer, William C., *Advanced Drilling Techniques,* Chapter 21, "Spark Drills", Petroleum Publishing Co., 1980, pp. 508–540.

Sandia Laboratories Energy Report, SAND75-0417, Jul. 1975.

Sandia Laboratories Energy Report, SAND76-0086, Jul. 1–Dec. 31, 1975.

*Primary Examiner*—Stephen J. Novosad

*Assistant Examiner*—Bruce M. Kisliuk

*Attorney, Agent, or Firm*—Hoffman, Wasson & Fallow

[57] ABSTRACT

A spark discharge focused drill provided with one pulse forming line or a number of pulse forming lines. The pulse forming line is connected to an array of electrodes which would form a spark array. One of the electrodes of each of the array is connected to the high voltage side of the pulse forming line and the other electrodes are at ground potential. When discharged in a liquid, these electrodes produce intense focused shock waves that can pulverize or fracture rock. By delaying the firing of each group of electrodes, the drill can be steered within the earth. Power can be fed to the pulse forming line either downhole or from the surface area. A high voltage source, such as a Marx generator, is suitable for pulse charging the lines.

29 Claims, 6 Drawing Sheets

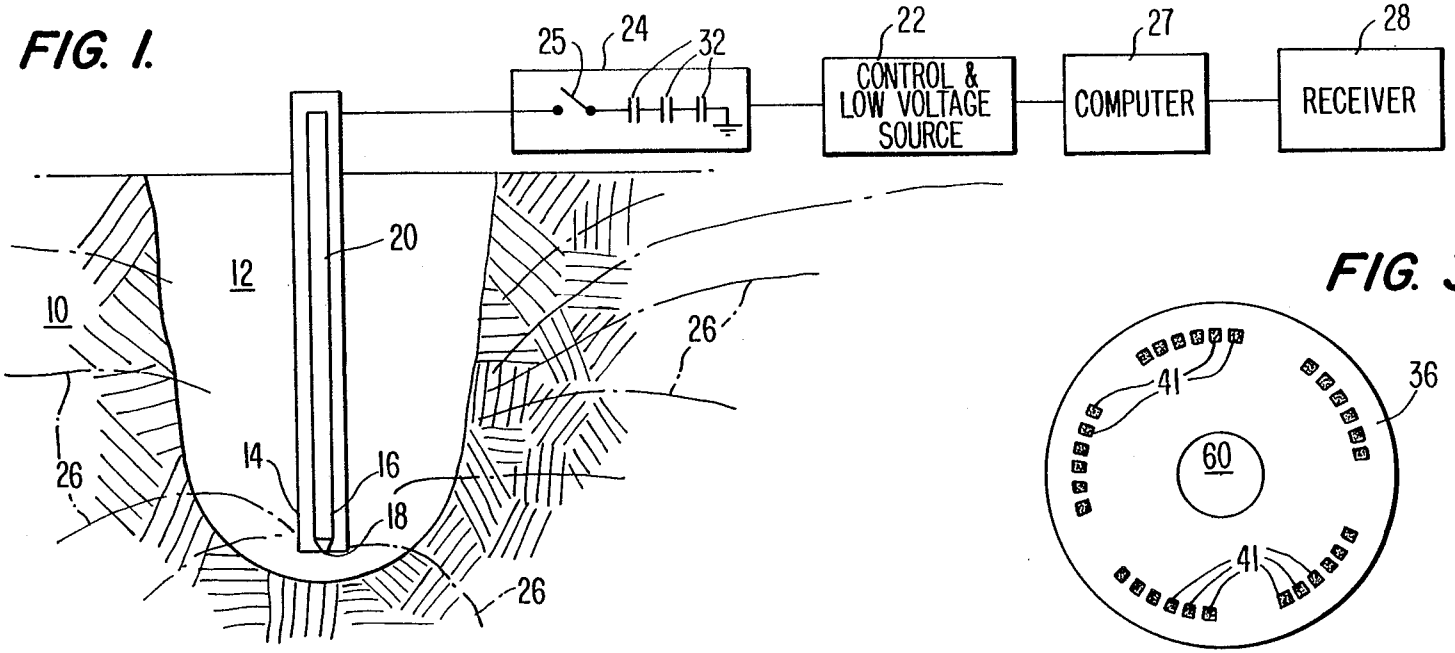
FIG. 1.
FIG. 3.
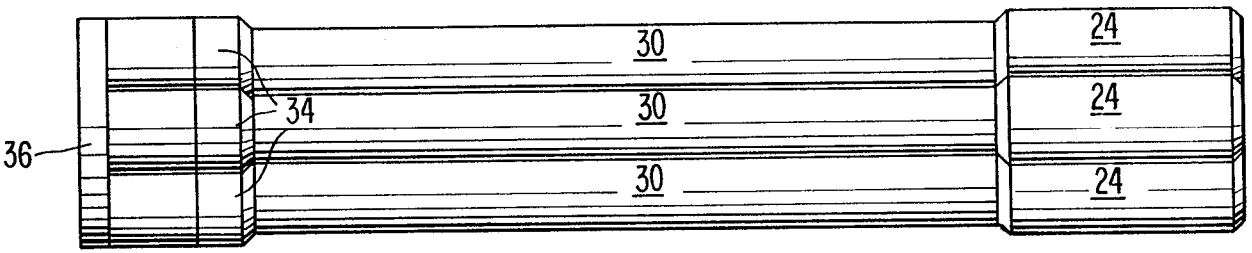
FIG. 2.

LOW IMPEDANCE TRANSMISSION LINE ENERGY TRANSFER

HIGH IMPEDANCE TRANSMISSION LINE ENERGY TRANSFER

FOCUSED SHOCK SPARK DISCHARGE DRILL USING MULTIPLE ELECTRODES

BACKGROUND OF THE INVENTION

Most conventional methods for drilling into the earth employ either an abrasive drill, which usually includes rotating steel bits, or abrasive loaded high-pressure jets. Although the abrasive cutting method has been shown to be effective in many situations, this method must be used within 8-12" bore holes, and the total energy delivered to the rock face during the cutting operation is limited. While explosives can be used for moving large masses of material, the precise repetitive cutting action which is needed for drilling a hole cannot be achieved with explosives.

Recently, it has become possible to utilize a pulsed electric power system which can store energy of several kj to greater than 100 kj up to multiple megajoules. These energies correspond to the energy release of one to several sticks of dynamite and can be switched into a load in time scales of less than one microsecond. The energy levels and discharge times of these pulsed power systems are comparable to high velocity explosives. Additionally, these pulsed power systems can be recharged and repetitively fired at relatively high rates. This type of pulsed electric power system can be utilized in a focused shock drill which transmits power electrically to the drilling head rather than relying on many miles of twisting drill stem pipe.

The energy can be discharged in powerful underwater sparks at the cutting face of the drill. Furthermore, this drill employs no moving parts in the well shaft, other than a descending drill bit and circulating drill mud. This system can reduce costs and the time-consuming process of changing drill bits since the bit employed by this focused shock drilling method has a much longer life than conventional abrasive drill bits. Additionally, because the focused shock drilling system does not rely on the hardness of steel for fracturing rock, it may be more effective in penetrating hot rock than conventional drilling methods.

Typical prior art spark discharge shock drills are described in U.S. Pat. Nos. 2,953,353 to Allen; 3,158,207 to Rowley; 3,500,942 to Smith, Jr.; 3,506,076 to Angona; 3,679,007 to O'Hare; 3,708,022 to Woodruff and 3,840,078 to Allgood et al. However, these prior art patents which use a spark discharge to assist a conventional abrasive drill or as the sole drill bit have met with limited practical success since the power generated at the drill bit could not effectively compete with conventional abrasive rotary drills. This ineffectiveness results from the fact that spark energy must be discharged before the spark channel in the drilling fluid has time to significantly expand and reduce the spark impedance and hence limit the peak pressure wave which is formed. This occurs in typically much less than one microsecond. Conventional high-energy capacitors require one to several microseconds or longer to discharge and, therefore, the majority of the stored energy cannot be effectively used. Additionally, the electrical impedance of an underwater spark changes very rapidly with time, making efficient energy transfer from the storage capacitor quite difficult. Furthermore, these prior art spark discharge drills could not be employed to actively steer the underground hole which was being developed.

SUMMARY OF THE INVENTION

The present invention overcomes the deficiencies of the prior art by providing a spark discharge drill for subterranean drilling comprising a plurality of pulse forming lines each of which transmits high voltage power to a series of electrodes. A spark discharge is produced across these electrodes which generates a focused shock wave in a liquid for pulverizing or fracturing rock. Although it is particularly advantageous to utilize a plurality of pulse forming lines, the exact number of which is not critically important, the invention could also operate employing a single pulse forming line which fires a multitude of electrodes. The use of multiple sparks in a phased acoustic array to focus the pressure waves can produce a pressure at the rock surface which can exceed the pressure immediately adjacent to an individual spark and may be similar to or greater than the sum of the pressure waves produced by the individual sparks.

Additionally, by delaying the triggering of certain sections of the phased array of sparks, the focal point of the resulting pressure wave is shifted, and hence the point of maximum rock fracture is redirected. The total pressure wave produced is still the same as the wave produced if no delay is provided. This particular method will allow the drill to be steered electronically from signals produced above ground.

Furthermore, the arrangement of an array of multiple sparks in series will substantially increase the impedance of the spark array and therefore improve the energy transfer efficiency from the high voltage power supply to the array.

Each of the electrodes in the spark array is separated by an insulator surface, particularly between the electrode tips. In one embodiment, if the electrodes do not extend beyond the insulator surface, by appropriate choice of electrode materials and insulators, the drill will erode uniformly across its cutting face, and the problem of flashover, which hindered prior art spark discharge, is used as an advantage. These drill bits can efficiently cut after one-two meters of erosion and will therefore be able to cut substantial distances without the drill bit being changed.

Pulse transformation and conditioning can take place either on the surface or in the bore hole. This power transfer can occur using either an alternating current or a direct current.

The pulse forming lines can be of several types, including concentric cylinder, Blumlein, slow wave structure, and discrete component pulse forming lines. All of these types are capable of being impedance tuned to match the spark characteristics and capable of storing energy for delivery to the sparks.

Another advantage of the present invention is that it can be employed to positively locate the drill during the drilling operation. This is of particular necessity when the drill is steered through the subterranean formation. Since the focused shock drill generates a strong acoustic wave that propagates through the rock and can be received at the surface, a feedback mechanism is incorporated into the control system of the drill so that the location information is received and transmitted to a control computer which then transmits steering controls to the drill.

Other advantages of the present invention will become readily apparent to those skilled in the art from the following description which shows and describes a preferred embodiment of the invention, simply by illustrating several of the modes best suited to carry out the invention. As will be realized, the invention is capable of a number of different embodiments and its details are capable of modification in various obvious aspects, all without departing from the scope of the invention. Accordingly, the drawings and description will be regarded as illustrative in nature and not as restrictive.

BRIEF DESCRIPTION OF THE DRAWINGS

The accompanying drawings, incorporated in and forming a part of the specification, illustrate several aspects of the present invention, and together with the description serve to explain the principals of the invention.

FIG. 1 is a schematic drawing of one embodiment of the present invention showing the drill within a rock formation;

FIG. 2 is a drawing of the focused shock drill showing a plurality of pulse forming lines and in-hole high voltage power supply;

FIGS. 3, 4 and 5 are drawings showing various focused shock spark arrays;

DETAILED DESCRIPTION OF THE PRESENT INVENTION

Figure 4:
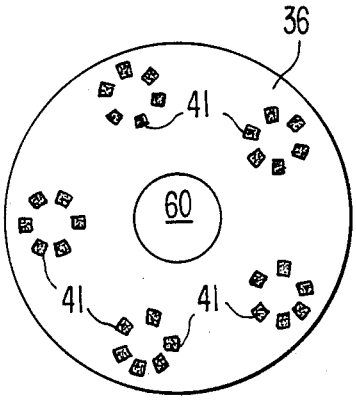

The present invention is directed to a spark discharge focused shock drill which may deliver a pulse of several kj up to 100 kj or more to the rock face at a rate of 1 to 10 pulses per second or more. The design of the present invention might make possible resonant fracturing of the rock by suitable timing of the pulses. A drilling fluid such as mud or water is transported from the surface to the rock face through the drill itself. This fluid is not abrasive in nature and is designed to facilitate the propagation of spark energy in the fluid at the face of the drill bit, to stabilize the rock formation, and to remove debris from the drilling operation back to the surface. A pulse charging system is located either within the drill stem of at the surface for producing energy to create a series of sparks at the drill bit directed at the rock face. Significant amounts of gas will be evolved during the underwater spark discharging and, in deep wells, this gas will expand and push the drilling mud ahead to form a bubble lift.

If the pulse charging network is provided on the surface, the power must be transmitted through the drill to the drill tip to produce a series of sparks. Such a system is shown in FIG. 1. This system shows a hole 12 which has been drilled from a rock formation 10. The drill 14 consists of a cylindrical casing of standard metallic material known in the art, such as stainless steel, which is used to protect the drill and as a ground electrode. A transmission line cable 20 is provided to the drill 14 and transmits high voltage energy produced by a high voltage source 24 to a pulse forming line 16 which is used to produce an array of sparks at the drill bit 18. Another line also transmits control information to the drill bit as will be explained below. A low voltage AC or DC source 22 is connected to the high voltage source 24. This low voltage source would produce power from a few hundred volts to 1 kv and is transformed in the high voltage source 24. Although several high voltage sources may be employed, the present invention utilizes a Marx generator provided with a switch 25 and a plurality of series connected capacitors 32 connected to ground. Each of the capacitors is separately charged, as shown in more detail in FIG. 13. Control signals are transmitted to the high voltage source 24 as well as the drill bit utilizing various modes of communication such as digital signals on an RF carrier or optical signals within optical fibers. The present invention can produce, for example, a series of one to ten pulses per second at 100 kj/pulse or an average power of between 100 kw to one Mw. Since one Mw is over 1300 horsepower, the power produced by the drill of the present invention is favorably compared to that of the conventional rotary drills which produce only between 20 and 50 horsepower at the bore hole face. Although FIG. 1 illustrates a drill employing a high voltage source outside the drill and on the surface, further enhancements will be discussed in which the high voltage source is provided within the drill.

Since the present invention produces a shock wave similar to that of a phased SONAR array of extremely high power, the focused shock drill itself can be used as a source of seismic impulses used to track the position of the drill bit and therefore the position of the hole. As shown in FIG. 1, a shock wave 26 is produced by the drill bit and this wave is received by an array of seismic monitors 28 positioned over the ground surface in the vicinity of the bore hole. Seismic time of arrival information can be processed in real time and a continuous display of the bore hole position and deviation from normal can be projected utilizing a computer 27. These deviations are then used to correct and guide the drill direction by generating steering signals from the surface.

FIG. 2 illustrates the drill itself including the spark array provided within the well bore. The drill is provided with a plurality of pulse forming lines 30 for the storage of energy. Each of these pulse forming lines is connected to a separate high voltage supply 24, although it is conceivable that a single high voltage power supply could be used to supply power to the various pulse forming lines 30 if a proper switching and timing capability is included between the high voltage power supply and the pulse forming lines 30. Although not shown in the drawing, a switch is provided between each of the pulse forming lines and its respective high voltage power supply 24. Each of the pulse forming lines 30 is connected to a spark array 36 provided with a plurality of electrodes through a respective switch 34. For the sake of clarity and simplicity, only three pulse forming lines 30 are shown in FIG. 2, although this particular embodiment utilizes five such pulse forming lines.

Figure 5:
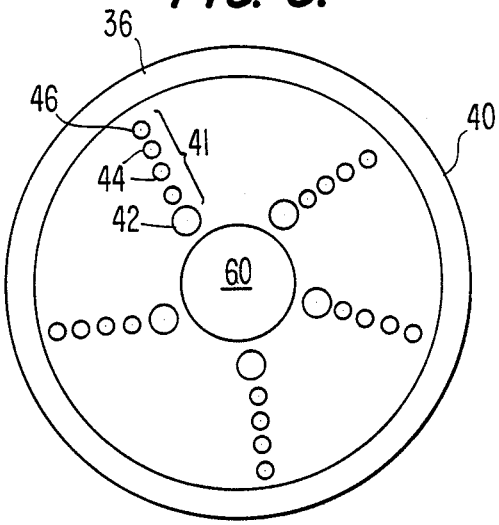

Various arrangements of the spark array 36 are shown in FIGS. 3, 4 and 5. The spark array consists of a plurality of groupings of electrodes, each grouping of electrodes provided with at least two and preferably five or more electrodes. Additionally, although the particular number of the groupings of electrodes is not crucial, it has been determined that utilizing five groupings of electrodes would be beneficial. FIG. 3 shows a spark array wherein a plurality of groupings of electrodes 41 is arranged along the periphery of the spark array. FIG. 4 illustrates an embodiment wherein each grouping of electrodes 41 is circular in nature. Additionally, FIG. 5 shows an embodiment wherein each grouping of electrodes 41 extends from the center portion of the spark array towards the outer circumference of the spark array.

Although FIGS. 3, 4 and 5 utilize different electrode configurations for the spark array 36, we shall discuss the electrodes in more particularity using the electrode configuration of FIG. 5. However, it should be stressed that all of the electrodes of the various spark arrays operate in the manner that will be discussed.

Figure 6:
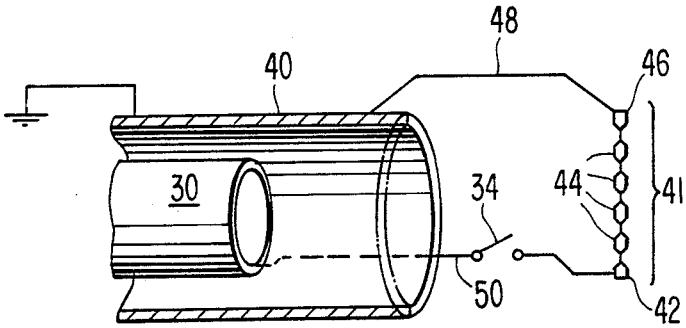
FIG. 6 is a drawing showing a connection of a pulse forming line to a spark array.

Each of the pulse forming lines can be formed from a metallic or conductive coated plastic tube. FIG. 6 shows only a single pulse forming line 30 within the drill casing 40 connected to electrodes 41, for the sake of simplicity. Most embodiments would be provided with several pulse forming lines 30 within casing 40 and the connection from each line to its respective electrode grouping would be similar to the connection shown in FIG. 6. As shown in FIG. 6, one of the electrodes 42 is denoted as the primary electrode and is connected by a wire 50 through the switch 34 to the high voltage side of its respective pulse forming line 30. A plurality of floating electrodes 44 is provided in series from and capacitively coupled with each other as well as the primary electrode 42 and a ground electrode 46. The ground electrode 46 is provided as the last electrode in the series and is directly connected to grounded casing 40 via line 48. Each of the electrodes 41 is separated from the other by a layer of hard insulation, such as ceramic.

Figure 8:
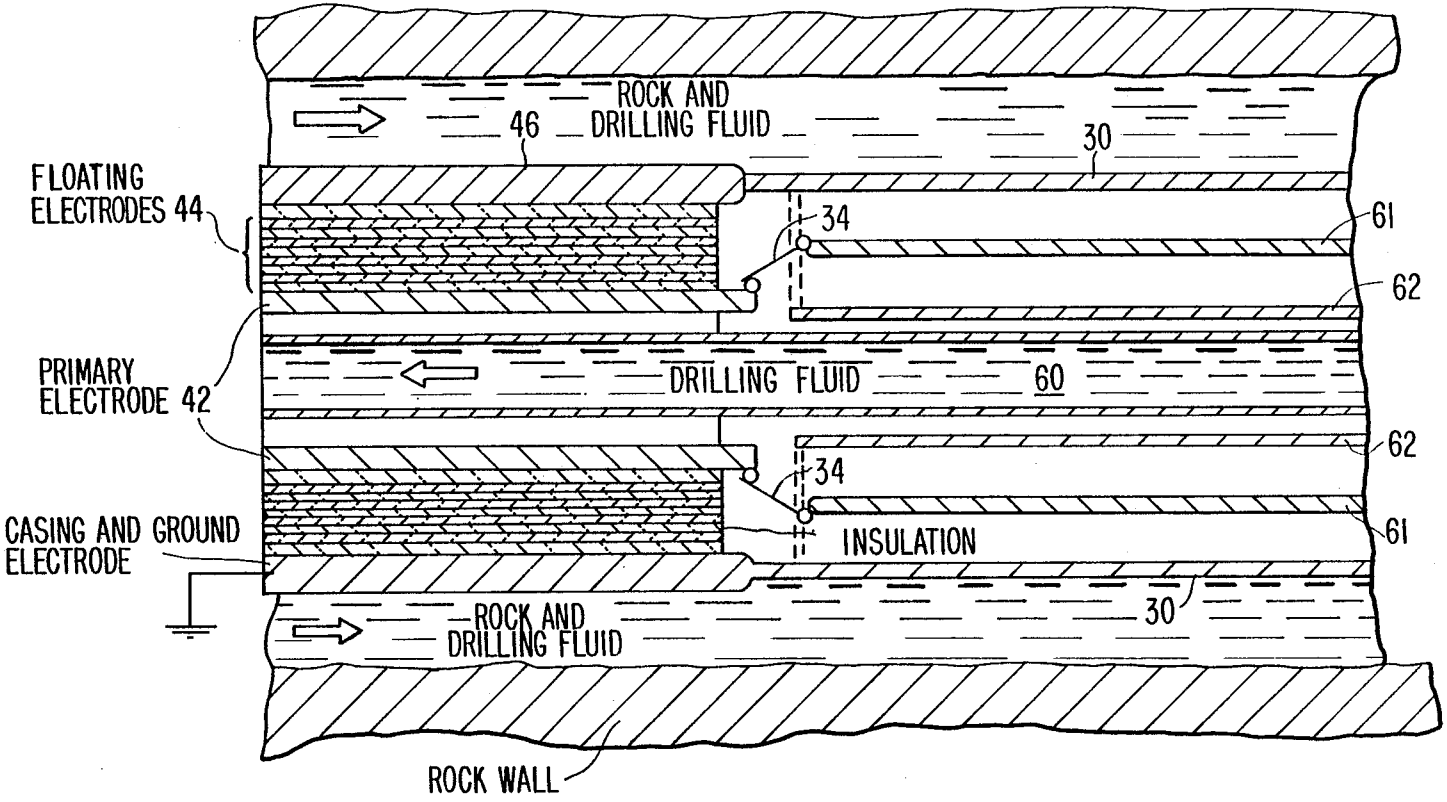
FIG. 8 is a cut-away drawing showing the focused shock drill.

FIG. 8 illustrates a cross-section of the focused shock drill positively illustrating two pulse forming lines 30 consisting of, in this instance, two concentric cylinders, each inner cylinder 61 separated from the outer concentric cylinder 62 of the same pulse forming line by a liquid such as water or oil. Each of the pulse forming lines is connected to the primary electrode of the spark array 42 via a switch 34. Drilling fluid such as water or drilling mud flows from the surface to the drill face via a drilling fluid port 60 provided in the middle of the drill. This drilling fluid and the resulting pulverized rock flow towards the surface around the exterior of the drill.

Figure 7:
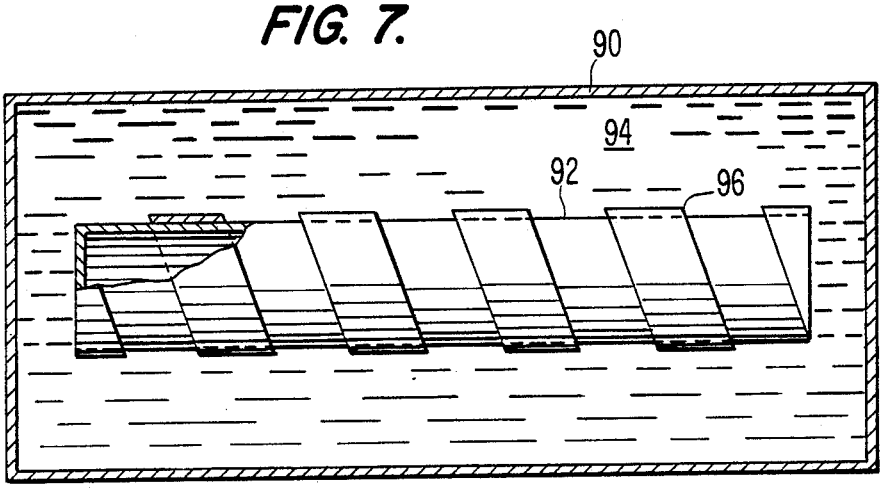
FIG. 7 is a cross-sectional view of a slow wave structure used as a pulse forming line.
Figure 9:
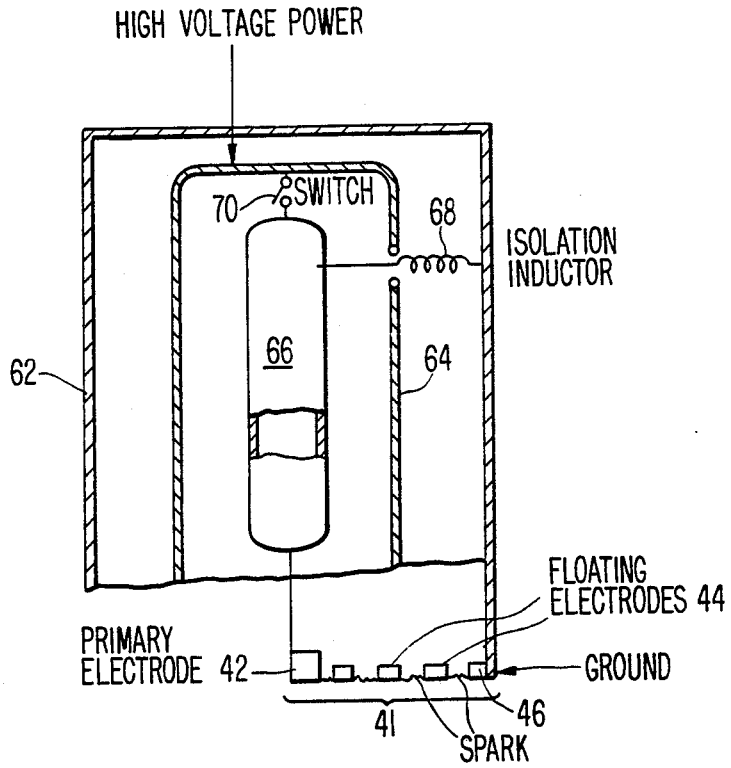
FIG. 9 is a drawing showing a connection of a pulse forming line with the electrodes.

A typical pulse forming line is shown in FIG. 9, which demonstrates the utilization of a Blumlein pulse forming line to store energy. It should be noted that the present invention could operate with equal facility employing a concentric cylinder pulse forming line, a slow wave pulse forming line, or a discrete component pulse forming line and that these pulse forming lines are known in the art. FIG. 7 shows the use of a slow wave pulse forming line and will be described in more detail later.

A Blumlein pulse forming line is an impedance matched energy storage line which stores the energy and delivers it to the spark array. The Blumlein pulse forming line consists of three concentric tubes 62, 64 and 66. Each tube is filled with a liquid such as water or oil that acts as an insulator for insulating each of the tubes from one another and at the same time stores the energy for the line. Although many types of fluids can be utilized, transformer oil having a dielectric constant of 2.4 can be employed as the insulating dielectric. While the energy storage capabilities of this oil are not very great compared to other liquids, the oil does not have to be pulse charged using a pulse charging circuit. For example, de-ionized water has a dielectric constant of 78 and can store substantial energy but must be pulse charged since it will conduct low current over a period of time. Additionally, glycerol has a high dielectric constant and must also be pulse charged, similar to water.

Initially, the inner tube 66 and the outer tube 68 are grounded and connected to one another by an isolation inductor 68. Next, the high voltage power source produces energy which is transmitted to the middle tube 64. Next, switch 70 is closed and the line discharges its energy into the spark array. Although it is not shown, a Marx generator consisting of a number of series capacitors (see FIG. 13) can be used to store the energy and pulse charge the pulse forming line at the proper time. This switching action can take place over a period of several to tens of microseconds. Once the Blumlein is charged, it can be triggered and its energy is delivered to the spark array, such as is shown in FIGS. 5 and 6. Once the pulse forming line is properly charged, switch 34 is closed and a voltage gradient will instanteously be created between the primary electrode 42 and its adjacent floating electrode 44. This voltage gradient generates the breakdown of a spark between the primary electrode and its adjacent floating electrode 44. The capacitance of the electrode itself acts to help generate this spark. After the production of the spark between the primary electrode 42 and its adjacent floating electrode 44, a spark is similarly created between this first floating electrode and its adjacent floating electrode. Thus, a series of sparks is sequentially created between the electrodes until a final spark is created between the last floating electrode and the ground electrode 46 which is connected to the grounded casing 40 via wire 48. By this method, nearly the entire supply voltage is applied to each successive spark. These successively delayed breakdowns will also take advantage of the two-step impedance collapse of underwater sparks. As each spark collapses to a low impedance value, the high voltage generator will be automatically switched to the next uncollapsed spark. Therefore, it is noted that once switch 52 is closed between the primary electrode and the pulse forming line, a series of sequential sparks is automatically produced. It should be noted that all of this sparking occurs within the drilling fluid.

An additional type of pulse forming line is shown in FIG. 7 which describes a slow wave structure which is a type of pulse forming line having inductive elements which modify the wave shape characteristics of the pulse forming line. As shown in this drawing, two coaxial tubes are provided. An inner dielectric tube 92, such as plexiglass, is provided which contains a copper tape coil center conductor in the form of a helix 96. Water or another dielectric fluid 94 is provided between the inner tube 92 and outer tube 90.

Figure 14:
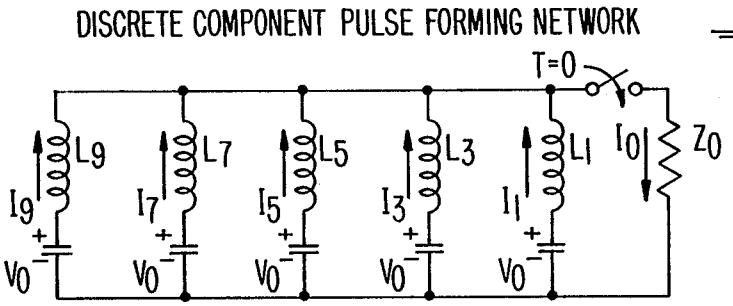
FIG. 14 shows a discrete component pulse forming network.

A further type of pulse forming line is illustrated with respect to FIG. 14 which shows a discrete component pulse forming network.

Figure 10:
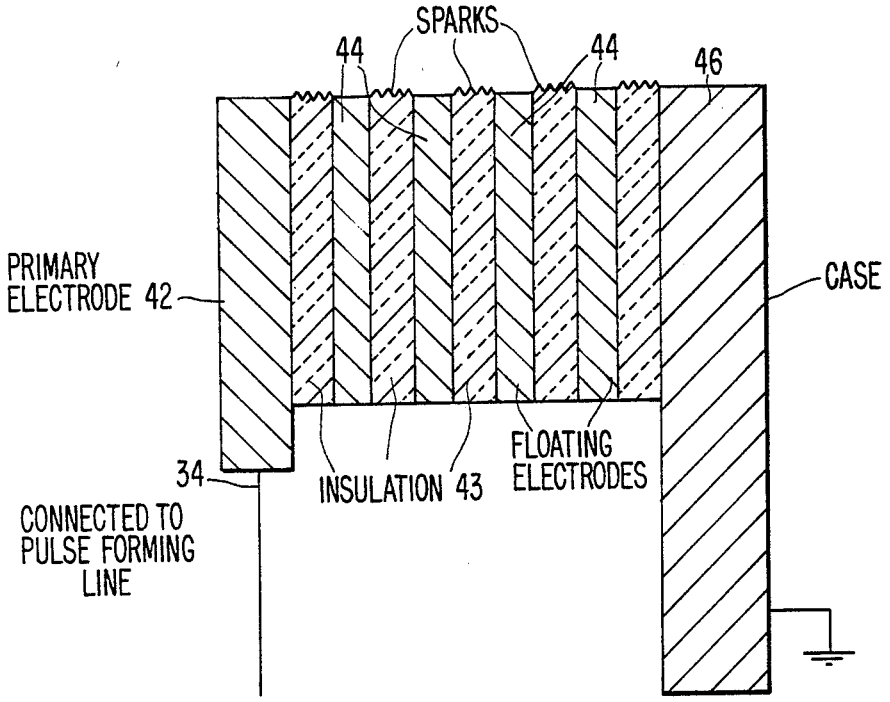
FIG. 10 is a drawing showing a set of erodable face drill bit electrodes.

The electrodes, which are usually constructed from a hard material, such as stainless steel, generally protrude an amount from the insulation 43, such as ceramic insulation. However, one embodiment of this invention utilizes electrodes which do not extend beyond the level of the insulation. Prior art spark discharge drills suffered from the problem of flashover wherein a spark flashed between electrodes over the surface of the insulation. One embodiment of the present invention does not eliminate this insulation flashover but uses it in a beneficial manner when the electrodes do not extend beyond the insulation surface. Referring to FIG. 10, the primary electrode 42 is connected to the high voltage side of one pulse forming line. Each of the succeeding floating electrodes 46 is capacitively coupled to ground and the series terminates on the ground electrode which is electrically coupled to the grounded drill case. Each electrode has a long stem extending from the base of the drill bit head section to the cutting face. During the generation of a large number of sparks across the electrodes along the surface of the insulation, all of the electrodes as well as the insulation provided therebetween will erode at approximately the same rate. This is true since the capacitance coupling between each of the electrodes insures that each electrode will reliably generate its own spark in a series sequence. This particular drill bit need not be replaced as often as conventional drill bits.

Figure 11:
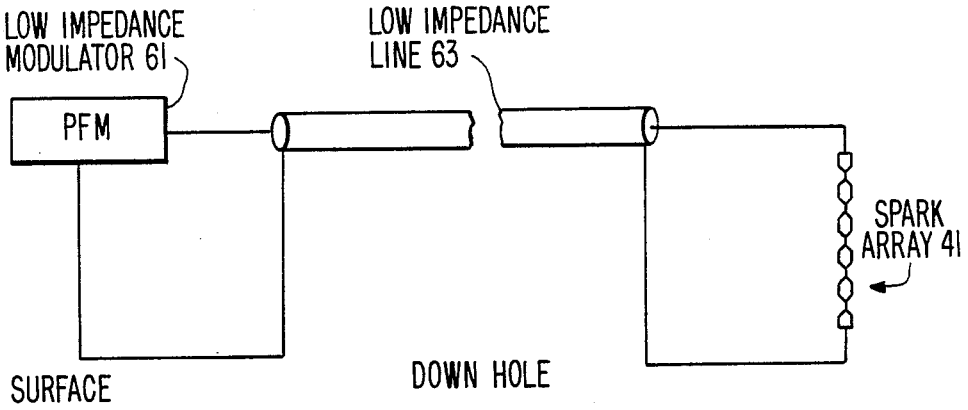
FIGS. 11 and 12 show impedance matching circuits utilizing surface power conditioning.

FIG. 11 describes a method for providing uphole power conditioning of the power needed to fire the spark array. A low impedance pulse forming modulator 61 is provided at the surface which consists of a power supply such as a Marx generator, a switch and a pulse forming line. The pulse forming line is connected via a switch to a low impedance transmission line 63 which is directly connected to the primary electrode and the ground electrode within the drill. All other switching of this embodiment is conducted at the surface, and therefore the pulse is conducted directly to the spark array for the drilling without the necessity of any downhole switching. This low impedance modulator 61 provides high voltage and high current.

Figure 12:
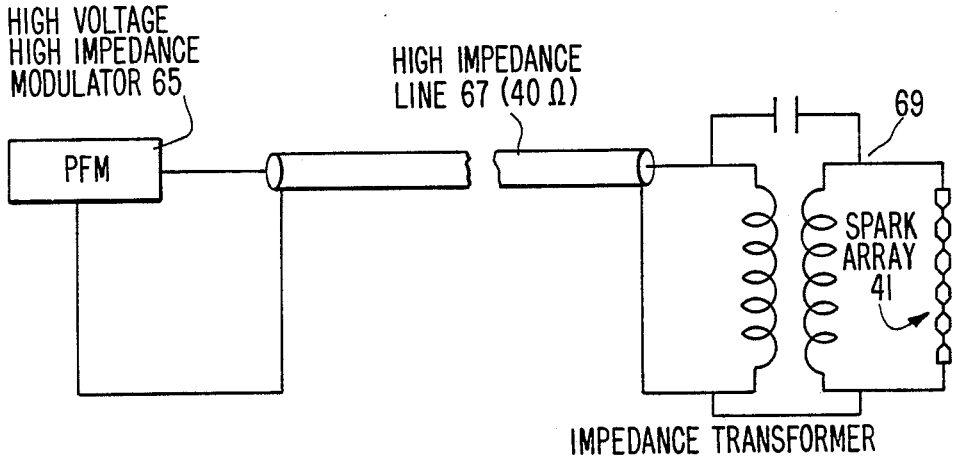

FIG. 12 illustrates a high voltage, high impedance modulator provided at the surface of the well. As was true with respect to the low impedance modulator, a pulse forming modulator 65 is provided which consists of a high voltage source, such as a Marx generator, a switch and a pulse forming line. However, since this embodiment employs high voltage and low current, a high impedance transmission line 67 is connected to the pulse forming line. An impedance transformer 69 is included in the drill for transforming a high impedance pulse to a lower impedance pulse which is then fed to the spark array. This approach produces a higher current pulse downhole than what was transmitted through the transmission cables, thereby reducing cable requirements while still providing primary power conditioning uphole. However, non-linear elements, such as switches, may be required in the impedance transformation section downhole for certain embodiments of the device.

Figure 13:
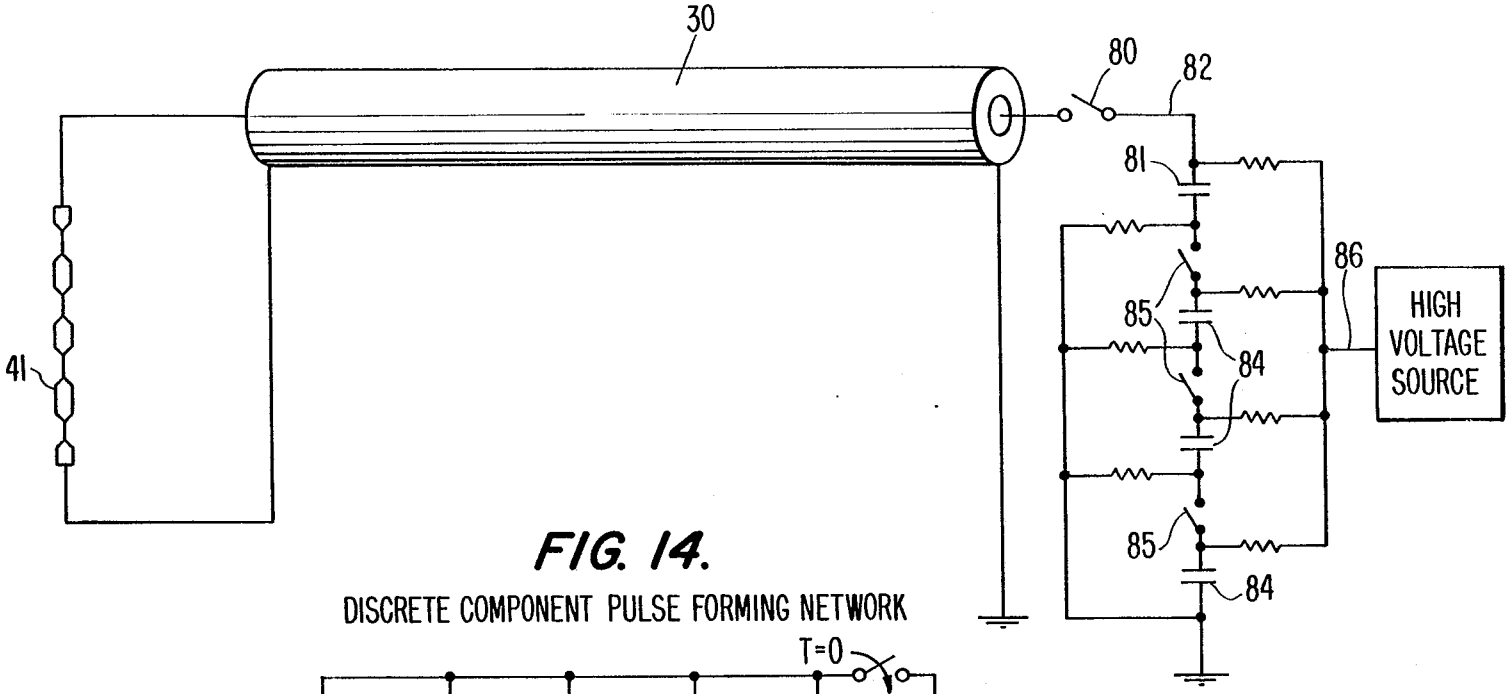
FIG. 13 shows a downhole power conditioning circuit.

FIG. 13 illustrates an embodiment in which downhole power conditioning is utilized for providing energy to the focused shock drill. Continuous alternating current having a reasonably high frequency, such as 400 hz, but having a moderate voltage of perhaps 5 kv, is transmitted downhole via a conventional power cable 86. This power is supplied to a downhole Marx generator having a plurality of series connected capacitors 84. The capacitors are charged in parallel and employ a separate switch 85 for each capacitor to accomplish the charging. Typically, this high voltage Marx generator would produce a voltage between 200 kv and 1.5 Mv. When switch 80 is closed, the voltage provided within these capacitors is transmitted via line 82 to a pulse forming line 30. At this time, the power provided in this line is then directed to the spark array in a manner previously described. Once the switch 80 is closed, the power is directly transmitted to the spark array, shown in FIG. 5, for example, including a primary electrode 42 and a plurality of electrodes 44. As was previously recited, the primary electrode 42 is connected via line 50 to the high voltage side of the pulse forming line 30 and a ground electrode is connected to the casing of the pulse forming line via line 48.

Two additional approaches could be utilized to provide downhole power conditioning. One approach envisions power being transmitted downhole to a resonant transformer circuit which charges a pulse forming line which in turn is switched to the spark array. A second embodiment would employ a magnetic switching transformer consisting of a transformer having a saturable core such that when current has built up to a particular level, the transformer switches energy into the pulse forming line which is in turn switched to the spark array. The pulse forming lines shown in FIGS. 11–13 as well as the additional drawings insure that the electric pulse will be shaped in time to provide the time varying impedance to the electrodes.

As shown in FIG. 2, each pulse forming line or transmission line is connected to the spark array 36 by a switch 34 between the pulse power line and the spark array or, in the case of a transmission line, shown in FIG. 13, between the high voltage source and the pulse forming line. Therefore, it can be appreciated that if these switches are all simultaneously closed, the energy of from several kj to 100 kj is deposited in the water and a focused shock wave is produced. When aimed directly at the rock face, a relatively large shock wave is produced which is used to fracture and pulverize the rock. If all the switches were closed simultaneously, the drill would be constantly directed at a single focal spot and a straight-line hole would be produced. However, if the switches were enabled at different periods of time, the spark arrays would be triggered and phased at different periods of time and the focal spot would move, and therefore the drill could be steered. As shown in FIG. 1, when the spark discharge is produced within a fluid medium, a seismic wave 26 is produced. This wave is received by various transducers placed on the surface. Therefore, the exact position of the drill within the well is determined and compared to the proper position of the drill. The deviation between these two positions is determined, employing the computer 27. This computer would also determine the proper sequence of the firing of the switches in order to steer the drill correctly. This proper sequence is transmitted to the control device 22 which controls the operation of the switches. Consequently, this control information is transmitted downhole to the requisite switch to control the firing of the spark array.

While the invention has been described with reference to various preferred embodiments, it is to be clearly understood by those skilled in the art that the invention is not limited thereto. Rather, the scope of the invention is to be interpreted only in conjunction with the appended claims.

The embodiments of the invention in which an exclusive property or privilege is claimed are defined as follows:

1. A spark discharge focused shock drill comprising:
a drill casing;
a source of potential;
a pulse forming line connected to said source of potential;
one set of electrodes provided within said drill casing and extending therein to form a drill face, said set of electrodes including a first electrode positively connected to said pulse forming line, a second electrode positively connected to ground potential and a plurality of third electrodes, said third electrodes including a first adjacent third electrode and a second adjacent third electrode, said plurality of third electrodes disposed near said first and second electrodes;
a working fluid provided in the drill surrounding the drill face; and
a first switch provided between said source of potential and said pulse forming line for causing a series spark array to be formed, when said first switch is closed, wherein a voltage gradient is created between said first electrode and a first adjacent third electrode such that a spark jumps the gap between said first electrode and said first adjacent third electrode, thereby subsequently establishing a voltage gradient between said first adjacent third electrode and a second adjacent third electrode, therefore creating a second spark jump and whereby additional spark jumps are created between said third electrode until a spark jump is created between the last of said third electrodes and said second electrode, all of said sparks produced within said working fluid to create a pressure wave directed against the material to be drilled.

2. The drill in accordance with claim 1 further including;
additional pulse forming lines each connected to said source of potential; and
additional sets of electrodes, one of said additional sets of electrodes for each of said additional pulse forming lines, each of said sets of electrodes provided within said drill casing and extending therein to form a drill face, and each of said sets of electrodes including (a) a first electrode positively connected to its respective pulse forming line, (b) a second electrode positively connected to ground potential and (c) a plurality of third electrodes disposed near said first and second electrodes; and wherein said first switch serially connects said source of potential to said plurality of pulse forming lines.

3. The drill in accordance with claim 2 further including:
a plurality of sources of potential, a separate source of potential connected to each of said pulse forming lines; and
additional first switches connected between each of said sources of potential and each of said pulse forming lines.

4. The drill in accordance with claim 3 further including a plurality of second switches, each of said second switches provided between one of said pulse forming lines and said first electrode of one of said set of electrodes.

5. The drill in accordance with claim 3 further including:
sensing means provided on the surface for sensing the occurrence of the pressure wave produced by the drill;
computer means connected to said sensing means for determining the exact position of said drill face; and
control means connected between said computer means and said first switches for determining the proper time for closing each of said first switches to enable said pressure wave and drill face to be properly steered.

6. The drill in accordance with claim 4 further including:
sensing means provided on the surface for sensing the occurrence of the pressure wave produced by the drill;
computer means connected to said sensing means for determining the exact position of said drill face; and
control means connected between said computer means and said second switches for determining the proper time for closing each of said second switches to enable said pressure wave and drill face to be properly steered.

7. The drill in accordance with claim 5 wherein said control means delays the switching of at least one of said first switches relative to the remainder of said first switches thereby delaying the firing of the first electrode connected to the delayed first switch.

8. The drill in accordance with claim 6 wherein said control means delays the switching of at least one of said second switches relative to the remainder of said second switches thereby delaying the firing of the first electrode connected to the delayed second switch.

9. The drill in accordance with claim 1 wherein said pulse forming line is a Blumlein pulse forming line.

10. The drill in accordance with claim 1 wherein said pulse forming line is a slow wave pulse forming line.

11. The drill in accordance with claim 1 wherein said pulse forming line is a concentric cylinder.

12. The drill in accordance with claim 1 wherein said pulse forming line is a discrete component pulse forming line.

13. The drill in accordance with claim 1 further including solid insulative material between each of the electrodes of said one set of electrodes, said one set of electrodes and said insulative material forming a continuous drill face and said one set of electrodes and said insulative material constructed from material which will erode approximately at the same rate when sparks repeatedly cross said insulative material between adjacent electrodes.

14. The drill in accordance with claim 2 further including solid insulative material between each of the electrodes of each of said additional set of electrodes, said each of said electrodes and said insulative material forming a continuous drill face and said additional set of electrodes and said insulative material constructed from material which will erode at approximately the same rate when sparks repeatedly cross said insulative material between adjacent electrodes of one set of electrodes.

15. The drill in accordance with claim 1 wherein said source of potential and said pulse forming line are provided outside said drill casing.

16. The drill in accordance with claim 3 wherein each of said sources of potential and each of said pulse forming lines are provided outside said drill casing.

17. The drill in accordance with claim 1 wherein said source of potential is a high voltage Marx generator.

18. The drill in accordance with claim 3 wherein each of said sources of potential is a high voltage Marx generator.

19. The drill in accordance with claim 1 wherein said source of potential and said pulse forming line are provided within said drill casing.

20. The drill in accordance with claim 3 wherein each of said sources of potential and said pulse forming lines are provided within said drill casing.

21. The drill in accordance with claim 15 further including a transmission line between said pulse forming line and said one set of electrodes.

22. The drill in accordance with claim 16 further including a set of transmission lines each of which is connected between one of said pulse forming lines and one set of electrodes.

23. The drill in accordance with claim 15 further including a transmission line between said transmission line and said one set of electrodes and an impedance transformer provided between said pulse forming line and said set of electrodes for matching the impedance of said transmission line to that of said spark array.

24. The drill in accordance with claim 16 further including a set of transmission lines each of which is connected between one of said pulse forming lines and one set of electrodes for matching the impedance of each of said transmission lines to that of said spark array.

25. The drill in accordance with claim 2 wherein said source of potential is a Marx generator.

26. The drill in accordance with claim 2 wherein said source of potential and said pulse forming lines are provided with said drill casing.

27. A spark discharge focused shock drill comprising:

a drill casing;

a source of potential;

a pulse forming line connected to said source of potential;

one set of electrodes provided within said drill casing and extending therein to form a drill face, said set of electrodes including a first electrode positively connected to said pulse forming line, a second electrode positively connected to ground potential and a plurality of third electrodes, said third electrodes including a first adjacent third electrode and a second adjacent third electrode, said plurality of third electrodes disposed near said first and second electrodes, said first, second and third electrodes arranged in such a manner to produce a focused pressure wave;

a working fluid provided in the drill surrounding the drill face; and a first switch provided between said source of potential and said pulse forming line for causing a series spark array to be formed, when said first switch is closed, wherein a voltage gradient is created between said first electrode and a first adjacent third electrode such that a spark jumps the gap between said first electrode and said first adjacent third electrode, thereby subsequently establishing a voltage gradient between said first adjacent third electrode and a second adjacent third electrode, therefore creating a second spark jump and whereby additional spark jumps are created between said third electrode until a spark jump is created between the last of said third electrodes and said second electrode, all of said sparks produced within said working fluid to create a focused pressure wave directed against the material to be drilled.

28. The drill in accordance with claim 27 further including:

additional pulse forming lines each connected to said source of potential; and additional sets of electrodes, one of said additional sets of electrodes for each of said additional pulse forming lines, each of said sets of electrodes provided within said drill casing and extending therein to form a drill face, and each of said sets of electrodes including (a) a first electrode positively connected to its respective pulse forming line, (b) a second electrode positively connected to ground potential and (c) a plurality of third electrodes disposed near said first and second electrodes; and wherein said first switch serially connects said source of potential to said plurality of pulse forming lines.

29. The drill in accordance with claim 27 further including:

a plurality of sources of potential, a separate source of potential connected to each of said pulse forming lines; and additional first switches connected between each of said sources of potential and each of said pulse forming lines.

* * * * *

UNITED STATES PATENT AND TRADEMARK OFFICE

CERTIFICATE OF CORRECTION

PATENT NO. : 4,741,405

DATED : May 3, 1988

INVENTOR(S) : Moeny et al.

It is certified that error appears in the above-identified patent and that said Letters Patent is hereby corrected as shown below:

Column 1, line 5 After "BACKGROUND OF THE INVENTION" please add

--This invention was made with Government support under Contract No. DE-FG02-85ER13330 awarded by the Department of Energy. The Government has certain rights in this invention.--

Signed and Sealed this

Fourteenth Day of February, 1989

*Attest:*

DONALD J. QUIGG

*Attesting Officer*

*Commissioner of Patents and Trademarks*